US005992404A

United States Patent [19]

Bleyer et al.

[11] Patent Number: 5,992,404

[45] Date of Patent: Nov. 30, 1999

[54] PROCESS AND DEVICE FOR CLEARING OUT JOINTS IN MASONRY

[75] Inventors: Hans-Rainer Bleyer, Eisfeld; Heinz Poppe, Jena, both of Germany

[73] Assignee: Jenoptik Aktiengesellschaft, Jena, Germany

[21] Appl. No.: 09/027,979

[22] Filed: Feb. 23, 1998

[30] Foreign Application Priority Data

Mar. 7, 1997 [DE] Germany ..... 197 09 557

[51] Int. Cl.[6] ..... B28D 1/00

[52] U.S. Cl. ..... 125/26; 451/36; 451/102

[58] Field of Search ..... 451/36, 37, 38, 451/60, 75, 99, 101, 102, 40, 39; 83/53, 177; 239/8, 336, 412, 407; 125/26

[56] References Cited

U.S. PATENT DOCUMENTS

| | | | |
|---|---|---|---|
| 3,972,150 | 8/1976 | Hart | 451/102 |
| 4,111,490 | 9/1978 | Liesueld . | |
| 4,165,587 | 8/1979 | Cottingham et al. | 451/102 |
| 4,768,709 | 9/1988 | Yie | 451/102 |
| 5,248,094 | 9/1993 | Munoz | 451/102 |
| 5,255,853 | 10/1993 | Munoz | 451/102 |
| 5,332,293 | 7/1994 | Higgins et al. . | |
| 5,536,200 | 7/1996 | Kiess | 451/102 |
| 5,605,492 | 2/1997 | Klingel | 451/102 |
| 5,759,086 | 6/1998 | Klingel | 451/102 |

FOREIGN PATENT DOCUMENTS

| | | |
|---|---|---|
| 0552751 | 7/1993 | European Pat. Off. . |
| 90 04 589 | 8/1990 | Germany . |
| 44 07 271 | 9/1995 | Germany . |
| 44 16 721 | 11/1995 | Germany . |

*Primary Examiner*—David A. Scherbel
*Assistant Examiner*—Derris Holt Banks
*Attorney, Agent, or Firm*—McAulay Nissen Goldberg Kiel & Hand, LLP

[57] ABSTRACT

A process and a device for clearing out joints in masonry is disclosed. The clearing out is effected by producing a groove by high-pressure water jets that are so oriented and guided relative to one another and relative to the desired groove. Further, a groove with a determined cross section of determined width and depth results.

6 Claims, 2 Drawing Sheets

PROCESS AND DEVICE FOR CLEARING OUT JOINTS IN MASONRY

BACKGROUND OF THE INVENTION a) Field of the Invention

Up to the present time, the clearing out of joints in masonry ducts or conduits for renovation purposes has been carried out in practice by means of cutting tools or shaping toots which are generally driven by hand-held machine tools for mechanically removing the joint mortar from the joint. The widths of the joints and the strength of the mortar, whose composition is frequently unknown, vary widely. In every case, the mortar must be removed as far as possible over the entire width of the joint and over a joint depth which is at least twice as large as the joint width in order to restore statically sound stability to the conduit by subsequent repointing. The extremely poor working conditions prevailing in such conduits in general and particularly when clearing out joints (high noise and dust nuisance, poor air) can be improved only with great effort, so that such endeavors tend toward the automation of this work process in such a way that a direct operation of the machine tool in situ is no longer required and operation is effected via a control unit outside of the conduit.

b) Description of the Related Art

DE U1 90 04 589 proposes a device with a work vehicle which can travel in the longitudinal direction of the conduit to be renovated and which is outfitted with a renovation tool in the form of a cutter and with at least one camera and with an operating console arranged remote from the work vehicle for controlling the work vehicle. With a device of this kind, it is no longer necessary for a work force to stay in the conduit while the joints are cleared out. Nevertheless, all of the disadvantages associated with clearing out by means of mechanical tools basically persist:

- high tool wear due to extensive continuous loading and high machining forces;
- high maintenance for the machine tools in order to prevent the effects on the driving accuracy and guiding accuracy of the workpiece caused by the resulting fine dust and to avoid impairment of the service life of the machine tool;
- relatively slow feed rate;
- along machining times, e.g., the minimum removal depth cannot be achieved by means of cutters in one machining step, so that the joint must be reworked repeatedly when cutting is used. In the case of saws, both joint edges are sawed one after the other and the remaining web is subsequently chiseled out.

The disadvantages indicated above make the clearing out of joints a time-consuming and costly process. Elaborate steps taken to automate this process cannot decisively increase the effectiveness of the process as long as the clearing out of joints is carried out by means of mechanical tools.

Water jet cutting is a known nonmechanical process for removing or severing material. The corresponding devices differ essentially in the shape and arrangement of the nozzles depending on the respective use. For example, for surface-oriented removal of material or to clean surfaces, a plurality of nozzles are arranged relative to one another in a plane of a nozzle head in such a way that they direct the water jet in the same direction. The nozzle head is set in rotation by means of its own drive or by means of an external drive. When cutting stone, for example, only individual nozzles are used, wherein an abrasive is added to the water depending an the hardness of the material in order to increase cutting power. For this purpose, the distance of the nozzle from the surface and possibly the size of the nozzle opening is selected depending on the material and the cutting depth of the water pressure. The cutting width is essentially invariable.

OBJECT AND SUMMARY OF THE INVENTION

The primary object of the invention is to provide a novel process and a novel device which make it possible to remove joint mortar from masonry using a nonmechanical process in such a way that a groove with a reproducible width and depth is formed which, when refilled, restores the required static stability to the masonry.

This object is met for a process according to the invention and for a device according to the invention in that at least two water jets with a determined pressure and a determined jet cross section are directed to the joint to be cleared out in such a way that they lie on a common plane at a right angle to the direction of the run of the joint and intersect at a joint depth corresponding to the desired depth of the groove.

The relative position of the jets with respect to one another and with respect to the joint determines the cross-sectional shape of the groove formed in the joint. The relative position of the jets with respect to one another is determined by a corresponding arrangement of the nozzles relative to one another, wherein the nozzles are arranged in a nozzle head or at a nozzle carrier so as to be fixed or adjustable relative to one another.

Due to the effect of the force of the water jets, the joint mortar is removed in the direction of the jet until the two jets converge resulting in a whirling which practically terminates the depthwise removal of the joint mortar and washes out the bottom of the resulting groove. The removal rate and the multiplicity of cross-sectional shapes for the groove that can be achieved can be increased by the rotation of the jets about a common axis of rotation.

An at least approximately rectangular groove shape results when one of the two nozzles is arranged at a determined distance from an axis of rotation so as to spray in the direction of the axis of rotation and the nozzle head rotates about this axis of rotation.

An at least approximately dovetail-shaped groove results when one of the nozzles is arranged so as to be inclined toward an axis of rotation and the other nozzle is arranged so as to be inclined away from the axis of rotation and the nozzle head rotates about this axis of rotation.

If both nozzles are arranged in a plane so as to be inclined relative to each other, a groove having an at least approximately triangular cross section is formed.

BRIEF DESCRIPTION OF THE DRAWINGS

The invention will be explained more fully hereinafter with reference to embodiment examples. In the drawings.

DESCRIPTION OF THE PREFERRED EMBODIMENTS

Figure 1:
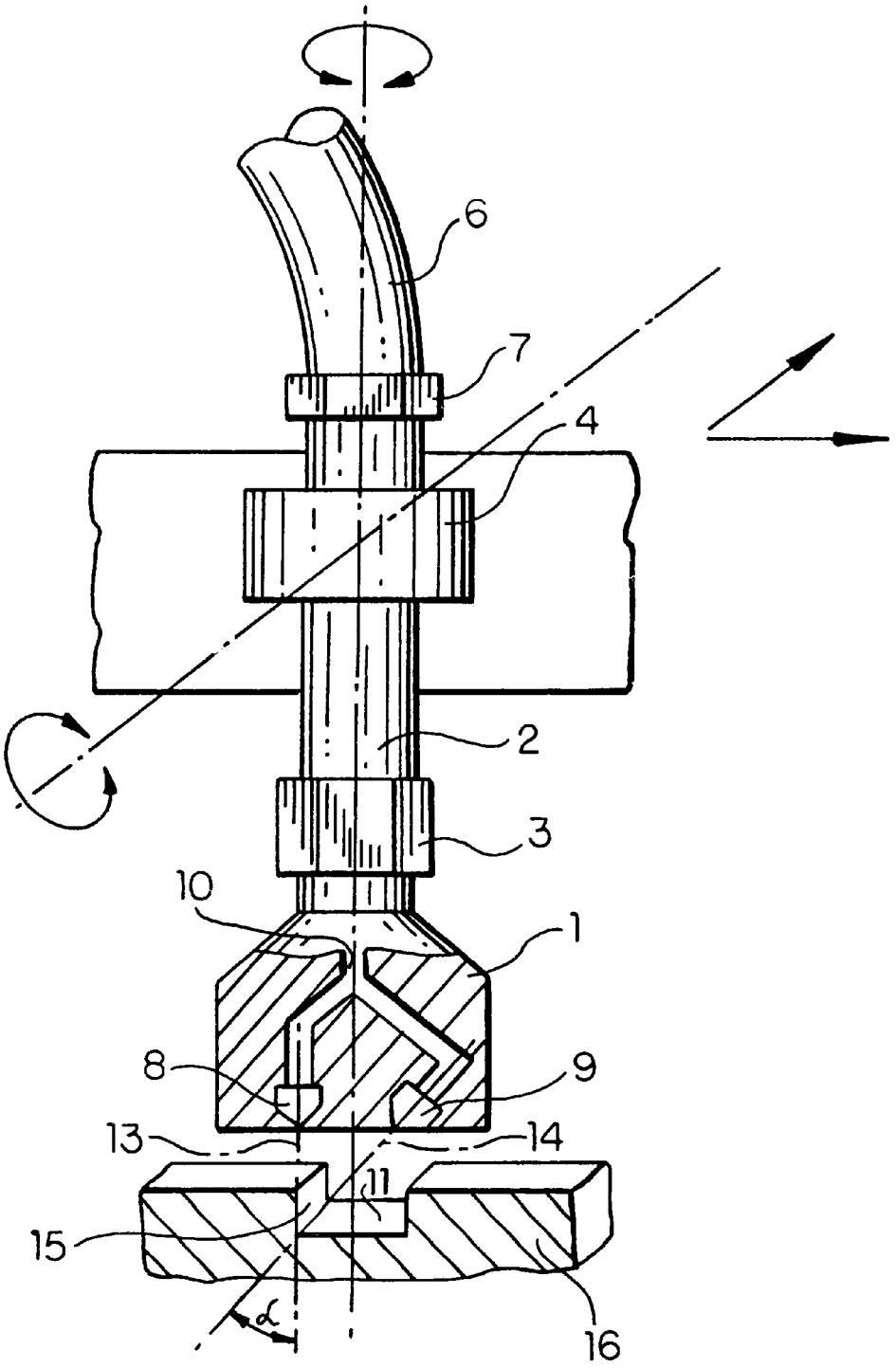
FIG. 1 is a schematic view of a device according to the invention with a nozzle head for clearing out a rectangular groove cross section.

FIG. 1 is a schematic view showing an embodiment form of a device for clearing out joints in accordance with the invention. This device essentially comprises a nozzle head 1, a spray tube 2 which is rigidly connected with the nozzle head 1 via a head coupling 3, a motor 4 which is fixedly connected with a device carrier 5 and sets the spray tube 2 in rotation relative to the device carrier 5 about its own axis, and a flexible supply line 6 which is connected with the spray tube 2 via a supply line coupling 7.

In this device, the configuration of the nozzle head 1 is essential to the invention.

The nozzle head 1 has a longitudinal axis 11 which constitutes an extension of the axis of the spray tube 2, so that the nozzle head 1 rotates about its longitudinal axis 11. A duct 10 guides the water from the spray tube 2 to the first nozzle 8 and to the second nozzle 9 in the nozzle head 1. The first nozzle 8 is arranged at a distance from the longitudinal axis 11 which corresponds to at least approximately half of the desired groove width. A first and piece of the duct 10 guided through the first nozzle 8 extends parallel to the longitudinal axis 11, while a second end piece which is guided through the second nozzle is arranged in a plane with the first end piece so as to be inclined at an angle $\alpha$ toward the longitudinal axis 11. The water stream from the first nozzle 8 flows in the direction 13 parallel to the longitudinal axis. The water stream from the second nozzle 9 has a direction 14, which is at the angle $\alpha$ to the longitudinal axis and thus is bent toward direction 13.

In principle, it is possible to accommodate this device structurally in a hand-held device, wherein the handle elements are indirectly fixedly connected with the device carrier. In the simplest arrangement, the nozzle head carries out only one rotational movement relative to the user. In this case, the user guides the device at the correct joint height along the joint and swivels it, if necessary, over the width of the joint. While the swiveling movement can also be realized within the hand-held device at only a slight extra expenditure on gearing, the automation of translational movements along the joint and, if necessary, in the case of variations in the height of the joint, relative to the base of the conduit is costly especially with respect to controlling apparatus.

The required relative movements can be realized just as in devices based on mechanical clearing processes through widely varying degrees of automation, although this is not the subject of the invention.

A nozzle head 1 which is predetermined with respect to its geometric dimensions is guided at a certain distance from the joint 15 in the masonry 16 so that the jets emerging from the first and second nozzle intersect at the desired groove depth. By means of the rotation of the nozzle head 1 about its longitudinal axis 11 and its side travel along the joint, a groove is formed with an essentially rectangular cross section. The cross section that is formed can be varied, e.g., by varying the diameter of the opening of the nozzle, changing the rotating speed, the distance, or the forward feed rate. Groove flanks diverging in depth are formed, for example, when the selected diameter of the opening of the second (inclined) nozzle is greater than that of the first.

The resulting joint surface is substantially more fissured than in mechanical clearing out processes because the joint mortar is not severed and removed in a defined manner, but rather is shattered and thrown out. Given the same volume of material removed, an uneven, fissured surface is also always a larger surface, which is advantageous for the task at hand, namely, the repointing of masonry, because there is a larger area of contact between the new joint mortar and the old joint mortar and masonry.

In a first practice-tested nozzle head according to FIG. 1, the first nozzle 8 was arranged at a distance of 5 mm from the longitudinal axis 11 and the second nozzle 9 was arranged so as to be inclined at an angle $\alpha$ of 23° and at a distance of 11 mm relative to the longitudinal axis 11. At a rate of rotation of approximately 2800 min−1, a water pressure of approximately 2000 bar and a distance of 15 mm between the joint and the nozzle head 1, a groove with a depth of approximately 25 mm and a width of approximately 10 mm was produced.

With a second nozzle head according to FIG. 1, the first nozzle 8 was arranged at a distance of 10 mm from the longitudinal axis 11 and the second nozzle 9 was arranged so as to be inclined at an angle $\alpha$ of 30° and at a distance of 16 mm relative to the longitudinal axis 11. At the same rate of rotation and water pressure and at a distance of 10 mm between the joint and the nozzle head 1, a groove with a depth of approximately 35 mm and a width of approximately 20 mm was produced.

When the first nozzle 8 is arranged so as to be inclined at an angle of less then $\alpha$ away from the longitudinal axis 11, a dovetail-shaped groove cross section is formed.

Figure 2:
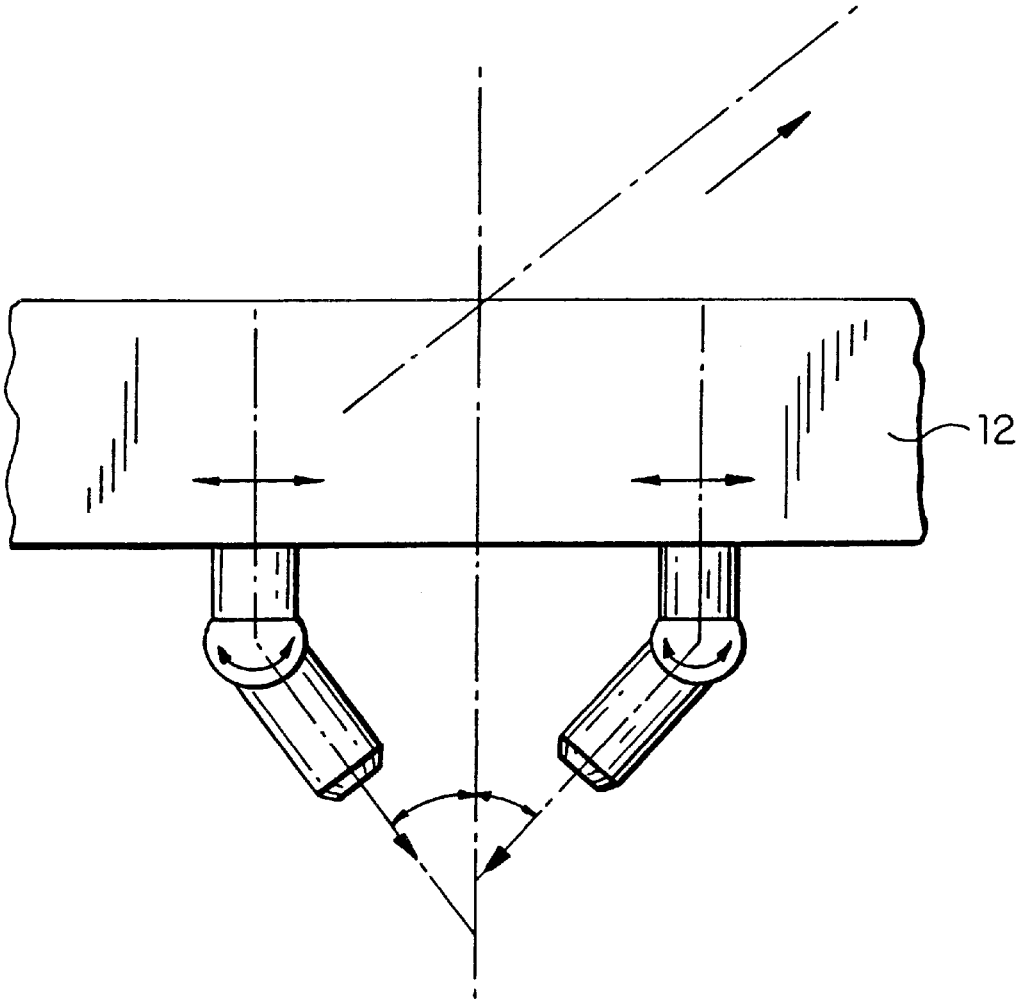
FIG. 2 shows a nozzle carrier with a nozzle arrangement for a triangular groove cross section.

The nozzles can also be fastened at a nozzle carrier 12, instead of in a nozzle head 1, so as to be adjustable with respect to their relative position. FIG. 2 shows a nozzle carrier 12 of this type. In this case, the two nozzles are arranged in a plane so as to be inclined relative to one another by the same angle. The resulting groove cross section is triangular. The length of the lateral sides of the triangle can be varied by changing the angles. A rotation of the nozzles does not take place.

As is demonstrated by the embodiment examples, rotation of the nozzles is not required for producing a groove, but is necessary for certain groove shapes.

An increase in the removal rate can be achieved when more than two nozzles are arranged. When three nozzles are used, the third nozzle must also spray in the plane with the first two nozzles and also through their point of intersection.

When four nozzles are used, each two nozzles must be oriented relative to one another such that they intersect at the desired joint depth and extend in a plane.

The process according to the invention and the arrangement according to the invention were developed in accordance with the stated object for clearing out joints, especially in masonry conduits. However, application of the invention is not limited thereto; rather the invention is applicable in general for introducing grooves in rock material, wherein the width and depth of the groove are of the same order of magnitude. This can apply, for example, to the installation of cable conduits for heating, sanitation or electrical systems.

While the foregoing description and drawings represent the preferred embodiments of the present invention, it will be obvious to those skilled in the art that various changes and modifications may be made therein without departing from the true spirit and scope of the present invention.

What is claimed is:

1. In a device for carrying out a process for clearing out joints in masonry in which a groove of determined width and depth is produced in a joint, comprising the steps of:

guiding at least two high-pressure water jets along a direction of a run of the joint;

said jets being oriented relative to one another in such a way that they lie in a plane at a right angle to the joint and intersect at a depth in the joint corresponding to a desired depth of the groove, said device for water jet cutting being provided with at least two nozzles which are arranged relative to one another in such a way that the emerging water jets intersect pairwise and lie on a plane at a right angle to a direction of the course of desired groove, wherein there is an axis of rotation between the nozzles in the plane of the emerging water jets and the nozzles rotate about this axis of rotation.

2. The device according to claim 1, wherein one of the two nozzles is arranged at a distance from the axis of rotation which corresponds at least approximately to half of the width of the desired groove and directs the water jet in the direction of the axis of rotation, so that a groove with a rectangular cross section is formed.

3. The device according to claim 1, wherein one of the nozzles is arranged so as to be inclined toward the axis of rotation and the other nozzle is arranged so as to be inclined away from the axis of rotation so that a groove with a dovetail-shaped cross section is formed.

4. The device according to claim 1, wherein the two nozzles are arranged so as to be inclined relative to one another so that a groove with a triangular cross section is formed.

5. The device according to claim 1, wherein there are exactly two nozzles.

6. In a device for carrying out a process for clearing out joints in masonry in which a groove of determined width and depth is produced in a joint, comprising the steps of:

guiding at least two high-pressure water jets along a direction of a run of the joint;

said jets being oriented relative to one another in such a way that they lie in a plane at a right angle to the joint and intersect at a depth in the joint corresponding to a desired depth of the groove, said device for water jet cutting being provided with at least two nozzles which are arranged relative to one another in such a way that the emerging water jets intersect pairwise and lie on a plane at a right angle to a direction of the course of desired groove, wherein outlet openings of the nozzles differ in size so that a removal rate and a cross-sectional shape of the groove can be varied.

* * * * *